United States Patent [19]

Schmiel et al.

[11] 4,068,351

[45] Jan. 17, 1978

[54] METHOD OF INCREASING THE CAPACITY OF A CARDING MACHINE

[75] Inventors: William J. Schmiel; Mark O. Schmiel, both of Charlotte, N.C.

[73] Assignee: RSM Co., Charlotte, N.C.

[21] Appl. No.: 704,229

[22] Filed: July 12, 1976

[51] Int. Cl.[2] ..... D01G 15/40

[52] U.S. Cl. ..... 19/105

[58] Field of Search ..... 19/105, 240, 145.7

[56] References Cited

U.S. PATENT DOCUMENTS

| | | | |
|---|---|---|---|
| 407,743 | 7/1889 | Proctor | 19/105 |
| 2,698,271 | 12/1954 | Clark | 19/156.3 X |
| 3,256,569 | 6/1966 | Draving | 19/105 X |
| 3,562,866 | 2/1971 | Roberson et al. | 19/105 X |

FOREIGN PATENT DOCUMENTS

| | | | |
|---|---|---|---|
| 546,201 | 3/1932 | Germany | 19/105 |
| 22,678 of | 1894 | United Kingdom | 19/105 |

*Primary Examiner*—Dorsey Newton

*Attorney, Agent, or Firm*—Bell, Seltzer, Park & Gibson

[57] ABSTRACT

The production capacity of a carding machine is increased greatly above the normal range by feeding the fibrous material into the carding machine at a linear speed much greater than the conventional rate and at least about 10 feet per minute, and wherein the fibrous material is fed into the card in the form of a thin, lightweight, substantially non-compacted batt, significantly lighter than the conventional weight of feed into a carding machine. The lighter weight of the fibrous material being fed and the increased rate of speed thereof are such as to provide an overall increase in the amount of fibrous material being fed into the carding machine with a corresponding increase in the production rate. In accordance with the invention, a separate drive means independent of the drive means for the lickerin, main cylinder and doffer cylinder, is provided for driving the feed roll at said increased rate of speed.

3 Claims, 4 Drawing Figures

METHOD OF INCREASING THE CAPACITY OF A CARDING MACHINE

This invention relates to improvements in carding, and it is a primary object of this invention to increase the production capacity of a carding machine so as to greatly exceed the normal production capacity of the machine.

It is a further object of this invention to reduce the maintenance problems attendant to the operation of a carding machine while obtaining an increased production therefrom.

Heretofore, in processing waste fibrous material such as chopped cords or yarns on a conventional cotton carding machine at relatively high rates of production, the fibrous material is customarily delivered to the feed roll section of the card from laps, chutes or other known means in the form of a relatively thick, somewhat compacted mass of fibers. This mass of fibers may be as much as two inches thick and 500 grams per square foot in weight. The feed rolls, operating at a slow rate of speed, receive this thick mass of fibers and slowly direct the same into engagement with the lickerin, where bunches of fibers pulled free from the slowly advancing mass and processed through the machine.

Numerous maintenance problems have been experienced in feeding such a relatively heavy mass of fibrous material to the card. For example, the thick mass of fibrous material may include entangled masses, clumps or wads of fibers or foreign material which may damage the delicate and expensive card clothing within the card. Also, maintenance problems have been experienced with the drive apparatus for driving the feed rolls and other moving parts of the card, due to the heavy loads and forces exerted by the large mass of fibers.

In accordance with the present invention, it was found that maintenance problems are substantially reduced by changing the manner and rate in which fibrous material is fed into the card.

More particularly, it was determined that by feeding the fibrous material to the lickerin in a form substantially thinner than before but at a substantially faster rate than the conventional rate of feed, not only are maintenance problems such as damage to card clothing, etc. reduced, but quite surprisingly the capacity of the carding machine for processing fibrous material is increased very significantly.

Fibers are delivered to the lickerin roll of the card from a feed section which includes a feed roll cooperating with a feed plate, or pair of cooperating feed rolls. The feed roll or rolls are normally driven at a relatively slow peripheral speed of up to about 5 feet per minute for feeding the fibrous material slowly into the lickerin roll.

Heretofore in the processing of waste fibrous material, the feed roll and plate or the cooperating feed rolls deliver a relatively thick compacted mass of fibers to the lickerin, generally weighing about 200 to 500 grams per square foot.

In accordance with this invention, the fibrous material is delivered to the feed roll or rolls and fed thereby to the lickerin in a form substantially thinner than before. More particularly, the fibrous material is delivered to the feed section of the card in the form of a thin, lightweight substantially non-compacted batt. Desirably, this batt of fibers is substantially less than an inch in thickness, e.g. on the order of about one-half inch, with the fibers being very loosely arranged and having such a low density that the batt is non-self-sustaining and practically transparent. Preferably, for the processing of waste fiber material, the weight of feed to the feed rolls is less than 75 grams per square foot, and most desirably within the range of 25 to 60 grams per square foot.

The feed roll or rolls are driven at a peripheral speed many times greater than the conventional rate. This increased rate of speed is preferably within the range of 10 to 20 feet per minute. Thus, while the weight of the fibrous material being fed to the carding machine is reduced, the rate of feeding the lighter weight mass of fibers is increased, with the net result being that a substantially greater number of pounds of fibers per unit time is delivered into the carding machine. The lighter weight of the feed results in less wear and damage to the card clothing surfaces, and enables the machine to more efficiently process the fibers.

The other operating components of the carding machine, i.e. the lickerin, main cylinder, and doffer cylinder, may be operated at the conventional rate of speed. However, it has been determined that best results are obtained when the rate of speed for these elements is increased slightly, for example up to about 25 to 30%. This may be accomplished by using the existing drive motor for the carding machine and changing the gearing or belting arrangements accordingly.

It is preferred that the feed roll or rolls of the carding machine be driven independently of the other operating parts of the machine, and most desirably by a separate motor having a variable speed transmission to permit varying the rate of speed of the feed rolls independently of the other parts of the machine. The rate of processing may thus be varied by varying the rate of speed of the feed roll section of the machine.

While various devices can be employed to deliver fibrous material to the feed roll section of the card in the loose, non-compacted, lighter than conventional form previously described, highly acceptable results have been achieved using a hopper feed apparatus in which an inclined spiked apron lifts fibrous material from a supply hopper and passes the same beneath a kicker comb operating in close engagement with the spiked apron so as to comb and open entangled masses of the fibrous stock while also preventing large clumps of fibrous stock from passing from the hopper. The spacing of the kicker comb relative to the spiked apron is much closer than the spacing conventionally employed in a hopper feed apparatus, and the combined action of the kicker comb and spiked apron serves as a preparatory treatment to open-up, fluff, and untangle the fibrous material prior to its introduction into the carding machine. The spiked apron is connected to the same separate drive means which operates the feed rolls so that the speed of the spiked apron and the feed rolls is correlated and fibrous material is delivered to the feed rolls at substantially the same rate as the feed rolls accept the fibrous material and deliver the same to the lickerin.

The improved method and apparatus of this invention has been found to be particularly suitable for processing waste synthetic fiber material, especially chopped yarns, chopped cords, or reprocessed waste tow such as the type shown in U.S. Pat. No. 3,643,416, to recover the constituent fibers therefrom for reprocessing. In such applications, production as high as 500 pounds per hour per card have been achieved. However, the invention also has application other than for processing waste fibers, such as in mills processing virgin natural or synthetic fiber or blends thereof.

Some of the objects and features of the invention having been stated, others will appear as the description proceeds, when taken in connection with the accompanying drawings, in which —

Figure 1:
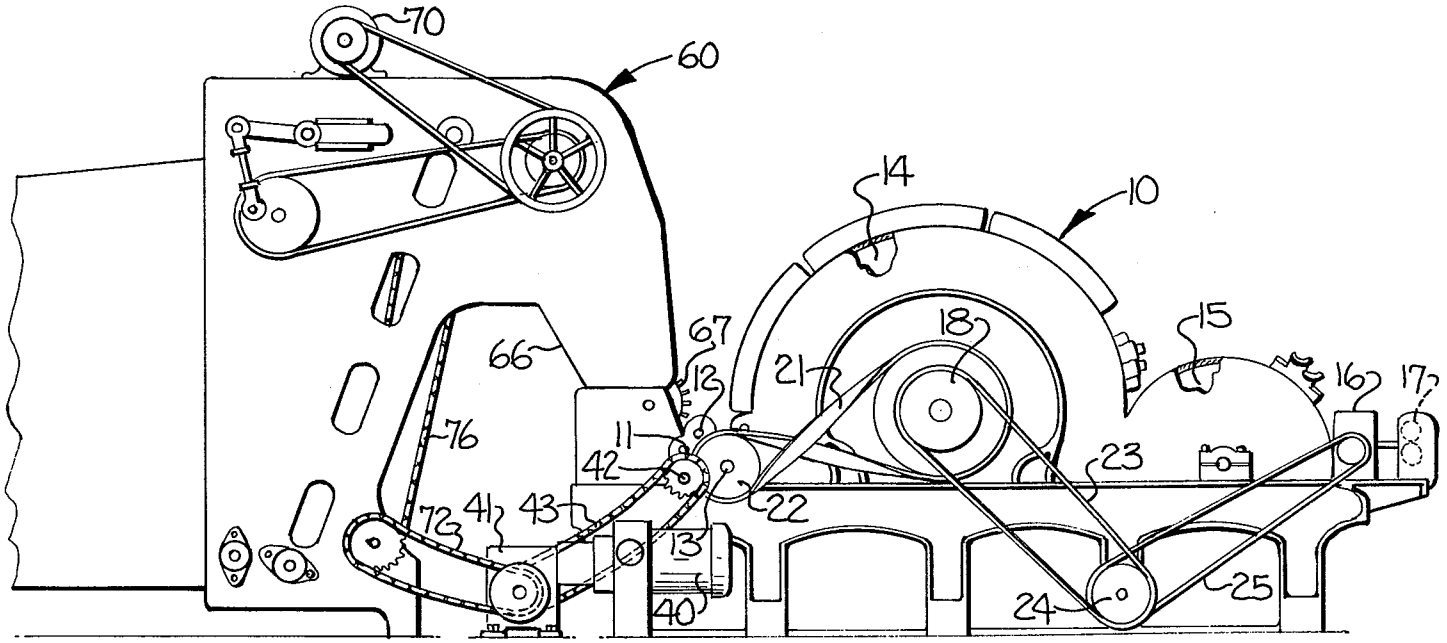
FIG. 1 is a schematic elevation of one side of an improved carding machine in accordance with this invention showing the improved drive mechanism therefor and with a hopper feed apparatus in association therewith.
Figure 2:
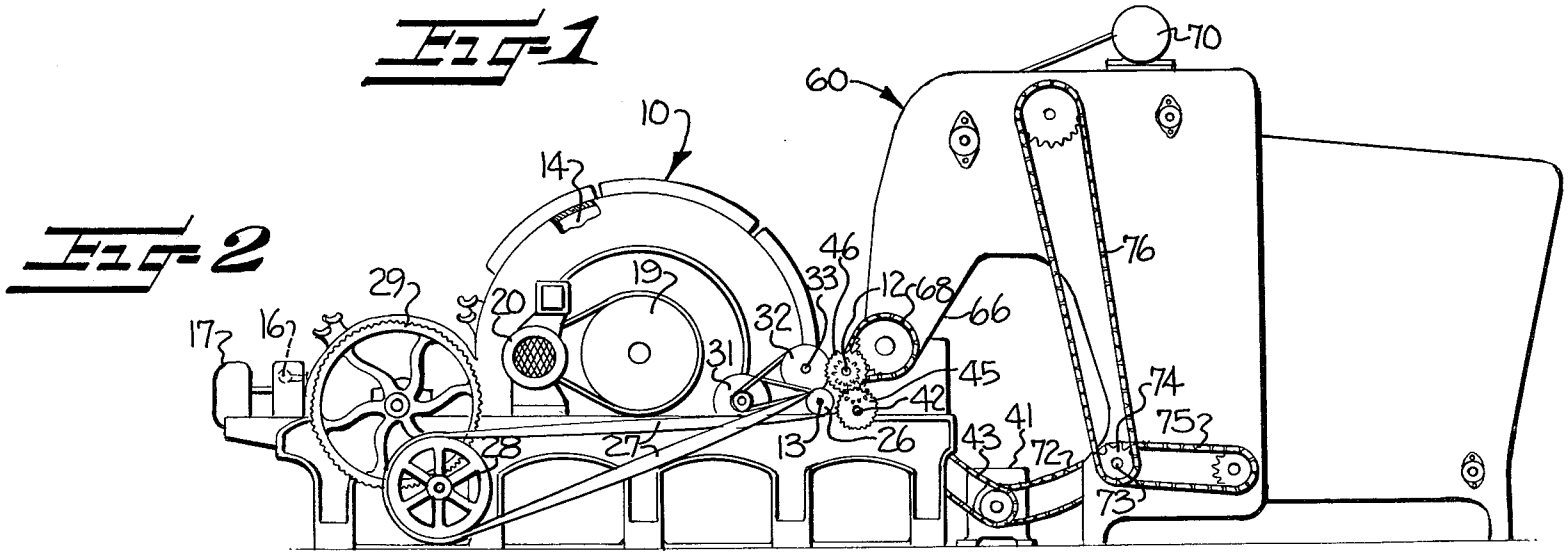
FIG. 2 is a schematic side elevation showing the opposite side of the structure shown in FIG. 1.
Figure 3:
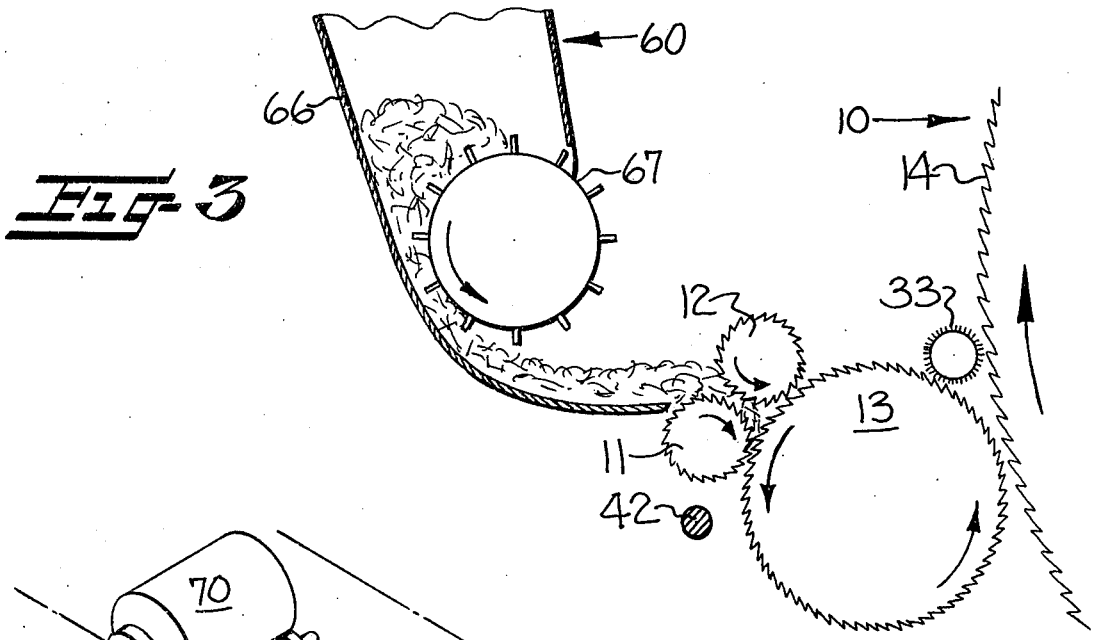
FIG. 3 is a fragmentary schematic sectional view showing the feed section of the carding machine and the apparatus for advancing fibrous material thereto.

Referring more specifically to the drawings, and to FIGS. 1 and 2 in particular, a conventional carding machine of the kind to which the present invention may be applied is indicated generally by the reference character 10. The principal working parts of the carding machine are as follows, their location being only generally indicated by the associated numerals: a feed solution including cooperating feed rolls 11 and 12, a lickerin roll 13, the main cylinder 14, the doffer cylinder or roll 15, the doffer comb assembly 16, and the calender and trumpet assembly 17 where the carded web is condensed into a sliver. In addition, there are pulleys 18 and 19 on each side of the machine connected to the shaft of the main cylinder. As is conventional, an electric motor 20, best seen in FIG. 2, is connected to the pulley 19 on one side of the machine to drive the main cylinder. The pulley 18 on the opposite side of the main cylinder drives a belt 21 connected to a pulley 22 associated with the lickerin roll 13 to thereby drive the lickerin roll. Pulley 18 also drives a belt 23 connected to an idler pulley 24 which, in turn, through belt 25 operates the doffer comb assembly 16.

Figure 4:
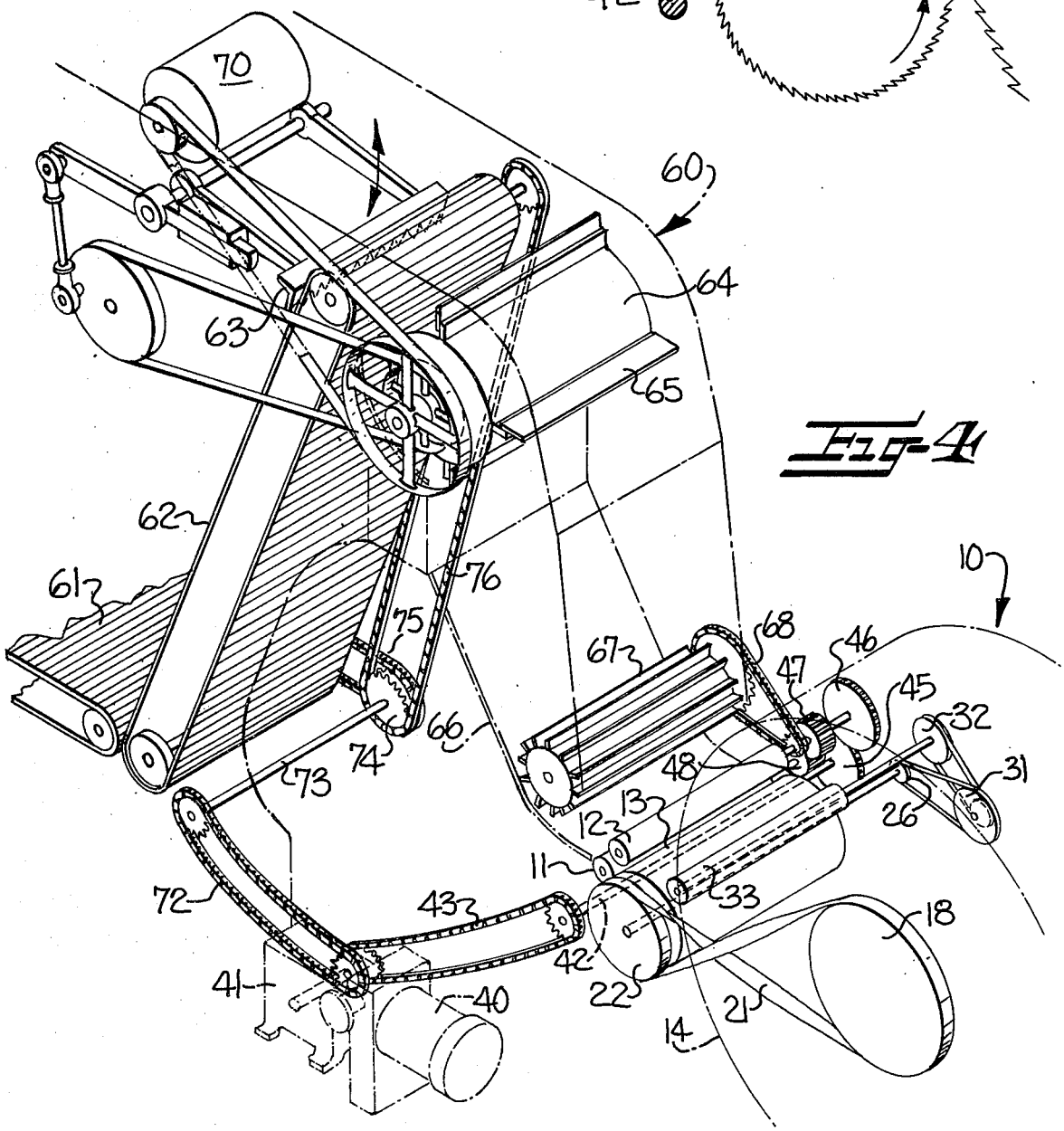
FIG. 4 is a schematic perspective view showing some of the interior working parts of the carding machine and the feed hopper apparatus.

As best seen in FIG. 2, the shaft of lickerin 13 has a pulley 26 which, through a belt 27, drives doffer pulley 28. The doffer pulley 28 engages a doffer drive gear 29 carried by the shaft of the doffer roll 15 so that the doffer roll is rotated at a relatively low rate of speed. As seen in FIG. 4, lickerin pulley 26 also drives a pulley 31 which, in turn, drives a pulley 32 connected to the shaft of a lickerin clearing roll 33. It will thus be seen that through the drive arrangement just described, the motor 20 drives the lickerin, main cylinder, doffer cylinder, and doffer comb as well as the clearing roll 33 and other conventional parts not specifically described herein.

In conventional carding machines, the feed roll or rolls are also driven by the same prime mover which drives the other working parts of the machine. For example, in one conventional arrangement power is supplied to the feed rolls through suitable bevel gears by an elongate shaft extending along one side of the machine and driven by the doffer roll. Such an arrangement is shown, for example, in McLean U.S. Pat. No. 3,092,875. The feed roll or rolls conventionally operate at about 4–6 RPM, providing a peripheral speed of up to about 5 feet per minute.

In accordance with the present invention, the feed rolls 11 and 12 are driven at a rate of speed many times higher than the conventional rate, and preferbly by a separate drive means independent of the drive for the other working parts of the carding machine. As illustrated, this separate drive means includes an electric motor 40 and a variable speed transmission 41 connected to the shaft of the motor 40. A feed roll drive shaft 42 is driven by the output of the variable speed transmission 41 through a chain 43 and sprockets 44. The feed roll drive shaft 42 drives both of the feed rolls 11 and 12 at the same rate of speed through a series of gears 45, 46, 47 and 48, as best seen in FIG. 4.

The cooperating feed rolls 11 and 12 have surfaces covered by teeth or spikes, as is conventional, for engaging the fibrous material. The feed rolls are preferably positioned in a very closely spaced relationship to one another with the toothed surfaces thereof in particularly meshing but non-contacting relation.

Any suitable means may be employed to deliver the fibrous material to the feed rolls 11, 12. However, in order to obtain the benefits of the increased throughput or operating capacity in accordance with this invention, it is most important that the fibrous material be in the form of a lightweight, loosely compacted mass of fibers, much lighter and less dense than the conventional feed to a card. Preferably, the fibrous material has a thickness of substantially less than one inch and a density of less than 75 grams per square foot, most desirably about 25–60 grams per square foot. This is in sharp contrast to the prior conventional manner of delivering waste fibrous material to the feed rolls, where the mass of waste fibers is dense and compacted and may be 2 inches in thickness and weigh as much as 500 grams per square foot. As illustrated, a hopper feed device 60 of known construction may be suitably employed for supplying the feed rolls with fibrous material.

Referring more particularly to the hopper feed device 60, as best seen from FIGS. 1 and 2, the device is located behind the input end of the carding machine and contains a housing for receiving a supply of fibrous material therein. Located inside the housing are a horizontal apron 61 and an inclined apron 62 (FIG. 4). The inclined apron 62 is provided with a spiked surface for engaging and lifting the fibers from the hopper. A reciprocating kicker comb 63 operating in close engagement with the spiked apron engages the fibrous material being lifted by the apron 62 and serves to comb and open the entangled masses of the fibrous material while at the same time preventing large clumps of the fibrous stocks from passing from the hopper and being fed to the card. The kicker comb 63 is positioned as close as possible to the spiked apron 62 without rubbing thereagainst so that only a very thin mass of fibers can pass thereunder. This spacing is substantially less than the conventional setting in this type of hopper feed apparatus. As the spiked apron reaches the upper extent of its travel and begins its downward parh, a rotating doffer roll 64 with a series of peripheral strips 65 clears the spiked apron of the fibrous material and directs the fibers downwardly to an inclined chute leading to the feed rolls.

A rotating pusher roll 67 having a bladed surface similar to a paddle wheel is provided near the bottom of the chute 66 to assist in advancing the fibrous material into engagement with the feed rolls. The pusher roll 67 is driven in timed relation with the feed rolls through a sprocket and chain arrangement 68 connected to the upper feed roll. The bladed surface of the pusher roll avoids compacting the loose mass of fibrous material while insuring that a thin, lightweight substantially non-compacted batt of fibers is always present at the feed rolls for being advanced into the carding machine.

Referring more particularly to the feed hopper apparatus 60, it will be seen that a separate motor 70 located at the top of the housing 61 is provided for operating the kicker comb 63 and the doffer roll 64. These elements are connected to motor 70 through a suitable system of pulleys and belts. Preferably, the kicker comb is operated at a speed greater than the speed conventionally employed in a feed hopper apparatus of this type to effect an increased amount of opening to the fibers. The spiked apron 62, however, is driven by the variable speed transmission 41 so that it is always operating in timed relation with the feed rolls 11, 12 of the carding machine. Thus, regardless of the speed setting of the feed rolls 11, 12, as determined by the variable speed transmission, the spiked apron 62 always delivers fibrous material at a rate correlated with the speed of the feed rolls.

Referring more particularly to the drive assembly for the spiked apron, it will be seen that a chain 72 connects a sprocket on the output shaft of transmission 41 with a similar sprocket on a shaft 73 located adjacent to the lower end of the spiked apron 62. A pair of sprockets 74 are provided at the opposite end of the shaft 73, and supply power to the lower apron 61 and the inclined spiked apron 62 through respective chain drives 75 and 76.

Thus it will be seen that the present invention provides a novel method and means for greatly increasing the operating capacity of a carding machine, and wherein the increase is achieved with a minimal expenditure and modification of the existing carding machine.

The following comparative example is provided to illustrate the results which can be achieved with this invention, but is not intended to limit the invention:

A Saco Lowell cotton card equipped with fixed flats and a set of cooperating 2¾ inch diameter feed rolls was used to process chopped waste polyester tire cord, operating with a feed roll speed of 5 RPM to provide an average production rate of 120 pounds per hour, based on average weekly production. The weight of the fibrous stock delivered to the feed rolls was determined to be about 84 grams per square foot. Continued maintenance problems were experienced involving sheared feed roll stands, stripped or damaged feed roll drive gears, and damaged card clothing.

The feed roll drive shaft and gears were replaced with a separate drive motor and variable speed transmission as described above. The variable speed transmission was adjusted to provide a feed roll speed of 28 RPM, with the type of fibrous material and other card settings remaining unchanged. The fibrous material was delivered to the feed rolls at a weight of about 45 grams per square foot. A sustained average production rate of 360 pounds per hour was achieved, representing a tripling of the production rate, with no appreciable decrease in quality of the card sliver and with marked decrease in maintenance problems.

In applying the method of this invention to the processing of other kinds of fibrous material besides waste fibers, such as virgin natural and synthetic fibers for example, the weight of the fibrous material being fed to the card will always be significantly light than the weight conventionally used for that particular kind of fiber in that particular usage. Thus, for example, in a quality cotton mill where the fibrous material is conventionally fed to the cards by laps or chutes at a weight of about 12 to 16 ounces per square yard, and with a feed roll speed of 4–6 RPM, the present invention would feed the stock to the card at a substantially lower weight, e.g. 6–8 ounces per square yard and at an increased feed roll speed of 18–28 RPM.

In the drawings and specification, there has been set forth a preferred embodiment of the invention, and although specific terms are employed, they are used in a generic and descriptive sense only and not for purposes of limitation.

That which is claimed is:

1. A method for processing fibrous material on a carding machine whereby the machine is capable of a substantially increased production capacity and with a significant reduction in maintenance, said method comprising delivering the fibrous material to the input end of the carding machine in the form of a thin, lightweight substantially non-compacted batt having a density of no more than about 75 grams per square foot, while feeding the fibrous material into the machine at a linear speed of at least about 10 feet per minute.

2. A method according to claim 1 wherein the fibrous material is delivered to the input end of the carding machine at a density of about 25 to 60 grams per square foot.

3. A method according to claim 1 wherein the step of feeding the fibrous material into the machine comprises advancing the fibrous material between a pair of cooperating feed rolls driven independently of the other moving elements of the carding machine and operating at a peripheral speed within the range of about 10 to about 20 feet per minute.

* * * * *

UNITED STATES PATENT AND TRADEMARK OFFICE

CERTIFICATE OF CORRECTION

PATENT NO. : 4,068,351

DATED : January 17, 1978

INVENTOR(S) : William J. Schmiel and Mark O. Schmiel

It is certified that error appears in the above-identified patent and that said Letters Patent are hereby corrected as shown below:

Column 1, Line 25, after "fibers" insert --are--; same column, Line 26, after "and" insert --are--. Column 3, Lines 28 and 29, "solution" should be --section--. Column 4, Lines 18 and 19, "particularly" should be --practically--; same column, Line 51, "stocks" should be --stock--; same column, Line 58, "parh" should be --path--. Column 6, Line 15, "light" should be --lighter--

Signed and Sealed this

Second Day of May 1978

[SEAL]

Attest:

RUTH C. MASON
Attesting Officer

LUTRELLE F. PARKER
Acting Commissioner of Patents and Trademarks